US007334695B2

(12) United States Patent
Bysick et al.

(10) Patent No.: US 7,334,695 B2
(45) Date of Patent: Feb. 26, 2008

(54) DEFORMATION RESISTANT PANELS

(75) Inventors: Scott Bysick, York, PA (US); Raymond Pritchett, Red Lion, PA (US); John Denner, York, PA (US)

(73) Assignee: Graham Packaging Company, L.P., York, PA (US)

( * ) Notice: Subject to any disclaimer, the term of this patent is extended or adjusted under 35 U.S.C. 154(b) by 507 days.

(21) Appl. No.: 10/658,797

(22) Filed: Sep. 10, 2003

(65) Prior Publication Data

US 2005/0051509 A1 Mar. 10, 2005

(51) Int. Cl.
*B65D 1/02* (2006.01)
*B65D 1/42* (2006.01)
*B65D 23/00* (2006.01)

(52) U.S. Cl. ..... 215/371; 215/900; 220/666; 220/660; 220/675

(58) Field of Classification Search ..... 215/379.383, 215/383, 384, 381, 382; 220/666, 675, 609.669, 220/671

See application file for complete search history.

(56) References Cited

U.S. PATENT DOCUMENTS

| | | | | |
|---|---|---|---|---|
| 5,279,433 | A | 1/1994 | Krishnakumar et al. | |
| 5,337,909 | A | 8/1994 | Vailliencourt | |
| 5,341,946 | A | 8/1994 | Vailliencourt et al. | |
| 5,407,086 | A * | 4/1995 | Ota et al. | 215/383 |
| D366,831 | S * | 2/1996 | Semersky et al. | D9/434 |
| D413,519 | S * | 9/1999 | Eberle et al. | D9/538 |
| 6,016,932 | A | 1/2000 | Gaydosh et al. | |
| D433,946 | S * | 11/2000 | Rollend et al. | D9/538 |
| D440,877 | S * | 4/2001 | Lichtman et al. | D9/539 |
| 6,273,282 | B1 * | 8/2001 | Ogg et al. | 215/381 |
| 6,460,714 | B1 | 10/2002 | Silvers et al. | |
| 6,494,333 | B2 * | 12/2002 | Sasaki et al. | 215/384 |
| 6,920,992 | B2 * | 7/2005 | Lane et al. | 215/381 |
| 6,932,230 | B2 * | 8/2005 | Pedmo et al. | 215/381 |
| 2005/0035083 | A1 * | 2/2005 | Pedmo et al. | 215/381 |

FOREIGN PATENT DOCUMENTS

| | | | |
|---|---|---|---|
| JP | 5310239 | A * | 11/1993 |
| JP | 2002326618 | A * | 11/2002 |
| WO | WO 97/34808 | | 9/1997 |
| WO | WO 01/74689 | | 10/2001 |

* cited by examiner

*Primary Examiner*—Sue A. Weaver
(74) *Attorney, Agent, or Firm*—Knoble Yoshida & Dunleavy, LLC

(57) ABSTRACT

A plastic container is provided. The plastic container has a substantially cylindrical sidewall, a base attached to a lower portion of the sidewall, a finish attached to an upper portion of the sidewall, and a vacuum panel located in the sidewall. The container also has a raised island protruding from the vacuum panel and surrounded by the vacuum panel, cross sectional areas of the island being defined as areas in horizontal planes of the container. The island has an upper portion, a middle portion adjacent to the upper portion, and a lower portion adjacent to the middle portion. A cross sectional area of the middle portion is less than a cross sectional area of the upper portion and less than a cross sectional area of the lower portion.

26 Claims, 9 Drawing Sheets

DEFORMATION RESISTANT PANELS

BACKGROUND OF THE INVENTION

1. Field of the Invention

The present invention relates generally to plastic containers, and more particularly to hot-fillable containers having deformation resistant vacuum panels.

2. Related Art

The use of blow molded plastic containers for packaging "hot fill" beverages is known. In the process of filling a plastic container with hot liquid, pressure or vacuum imposed on the container can result in permanent deformation of the container. The sidewalls of the container can deform as the container is being filled with hot fluids. In addition, the rigidity of the container decreases after the hot fill liquid is introduced into the container. The temperatures employed in these operations can be above the Tg of the plastic used (for example PET), which can result in the deformation becoming permanent. In addition, as the liquid cools, gas that is also in the container shrinks in volume, producing a vacuum in the container.

Hot fill containers often have substantially rectangular vacuum panels that are designed to collapse inwardly as the contents of the container cool after the hot-fill process. These vacuum panels help reduce unwanted deformation of the container by flexing inward under the pressure of the vacuum. By flexing inward, the vacuum panels relieve pressure created by the vacuum and prevent or reduce the deformation of other parts of the container.

U.S. Pat. No. 5,341,946 shows vacuum panels having multiple outwardly projecting portions which are separated by a portion of the vacuum panel. U.S. Pat. Nos. 5,279,433 and 6,016,932 show other configurations of vacuum panels having projecting center portions. Yet another configuration of vacuum panels having projecting center portions is shown in WO 97/34808.

The invention addresses design problems inherent with the panel designs discussed in the above-referenced patents.

BRIEF SUMMARY OF THE INVENTION

The present invention provides an improved blow molded plastic container that has an improved vacuum panel design. The design includes additional structural elements which resist the expansion tendencies present in prior art container structures. The expansion results in container bulging or barreling due to the inherent pressure induced during the filling operation. The invention provides a panel having a raised island. The island can have a shape such that a portion of the island has a smaller cross sectional area than other portions of the island. For example, the island can have a smaller cross sectional area at its center portion (in the vertical direction of the container). The smaller cross sectional area can result from the island having a horizontal rib or the island having a figure "8"/peanut-like shape.

In the case of a horizontal rib, the rib has a depth (in the radial direction of the container) such that the island structure is not completely divided by the rib. In other words, the rib is not coplanar or flush with the surface of the vacuum panel. The rib preferably has a depth such that sufficient island structure exists between the rib and vacuum panel to prevent the rib acting as a hinge between the divided portions of the island. The overall effect of the horizontal rib is to resist the expansion of the outer wall of the container. Bulging or "barreling" is prevented or diminished when the container is subjected to fill pressure at high temperatures.

These structural improvements to resist expansion can be used in conjunction with panel technology that allows for increased flexing of the vacuum panel sidewalls so that the pressure on the container may be more readily accommodated. Reinforcing ribs of various types and location may still be used, as described above, to compensate for any excess stress that will inevitably be present from the flexing of the container walls into the new "pressure-adjusted" condition by ambient forces.

The Figure "8"/peanut shaped island functions in a similar fashion to the horizontal rib. The indentations associated with the figure "8"/peanut shape also impart a rigidity to the overall side wall structure to resist bulging or barreling.

Panel designs in accordance with the invention also (1) improve overall dent resistance due to reduced vacuum pressure resulting from product volume reduction, (2) provide improved label support, and (3) because of reduced vacuum pressure, allow the reduction of container weights, affording an increased number of design options for other container portions.

Particular embodiments of the invention provide a plastic container having a substantially cylindrical sidewall, a base attached to a lower portion of the sidewall, a finish attached to an upper portion of the sidewall, and a vacuum panel located in the sidewall. A raised island protrudes from the vacuum panel and is surrounded by the vacuum panel, cross sectional areas of the island are defined as areas in horizontal planes of the container. The island has an upper portion, a middle portion adjacent to the upper portion, and a lower portion adjacent to the middle portion. A cross sectional area of the middle portion is less than a cross sectional area of the upper portion and less than a cross sectional area of the lower portion.

Other embodiments of the invention include adding two vertical ribs to the vacuum panel. The vertical ribs can be indentations in the vacuum panel. The island can be located between the vertical ribs.

Other embodiments of the invention provide a method of reducing deformation in a plastic container. The method includes providing the container with a substantially cylindrical sidewall, providing the container with a base attached to a lower portion of the sidewall, providing a finish attached to an upper portion of the sidewall, and providing a vacuum panel located in the sidewall. The method also includes providing a raised island protruding from the vacuum panel and surrounded by the vacuum panel, cross sectional areas of the island being defined as areas in horizontal planes of the container. The island is provided with an upper portion, a middle portion adjacent to the upper portion, and a lower portion adjacent to the middle portion. A cross sectional area of the middle portion is less than a cross sectional area of the upper portion and less than a cross sectional area of the lower portion.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of preferred embodiments of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

A thin-walled container in accordance with the invention is intended to be filled with a liquid at a temperature above room temperature. According to the invention, a container may be formed from a plastic material such as, for example, polyethylene terephthlate (PET) or polyester. One method of producing such a container is blow molding. The container can be filled by automated, high speed, hot-fill equipment.

Figure 1:
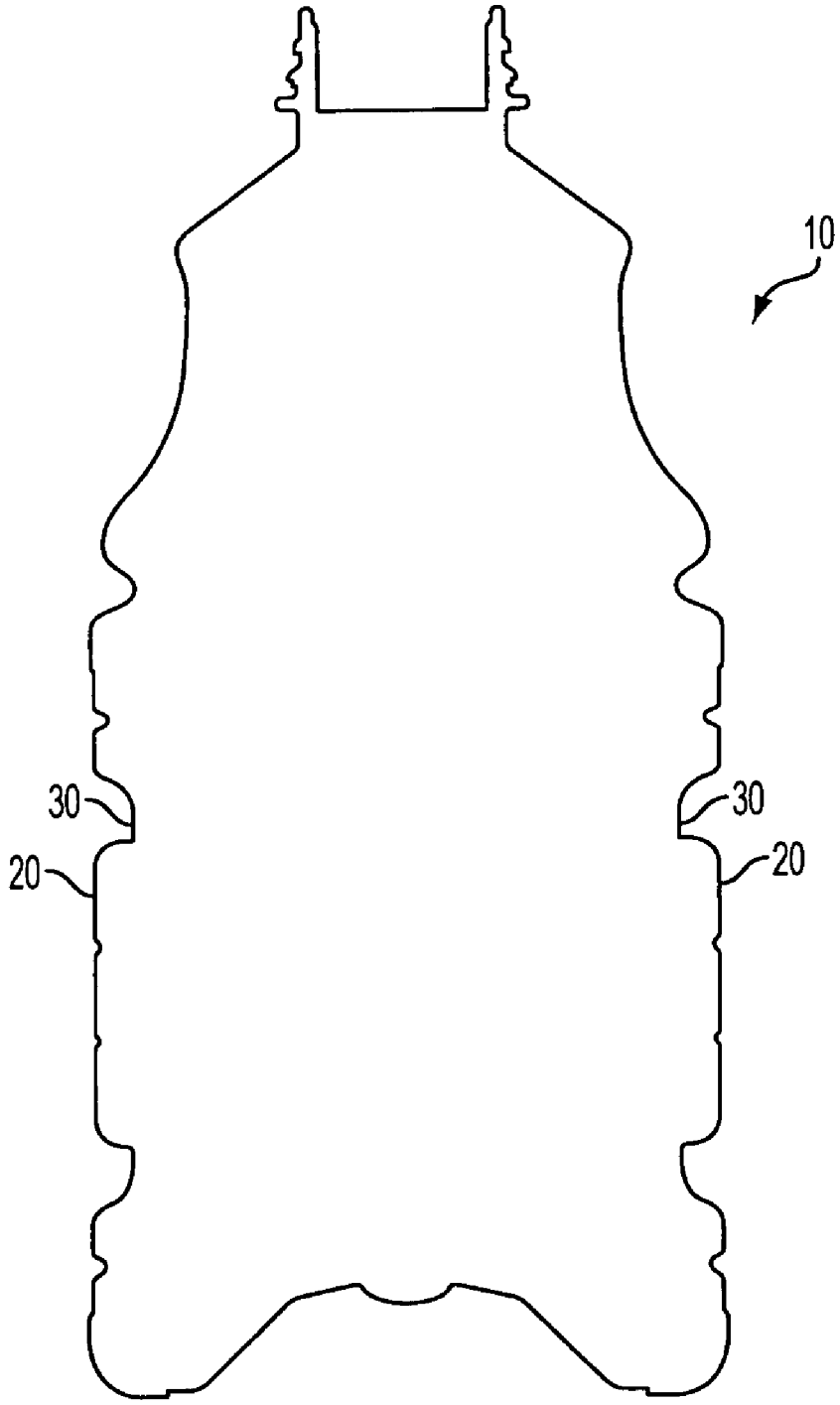
FIG. 1 RELATED ART
FIG. 1 shows a vertical section of a container having vacuum panels known in the related art.
Figure 2:
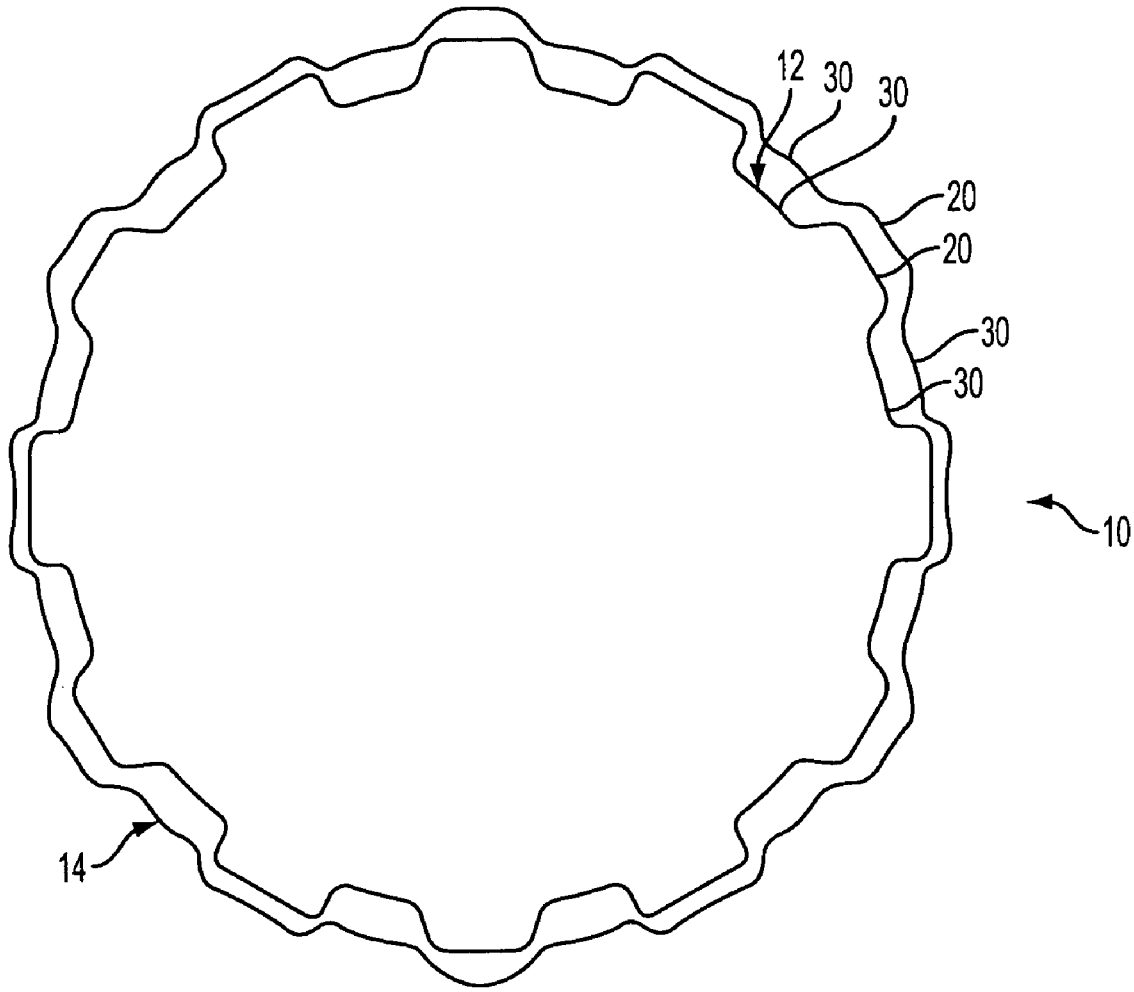
FIG. 2 RELATED ART
FIG. 2 shows two horizontal, mid-panel sections of the container shown in FIG. 1, one section shows the container's nominal cross section and the other shows the container's cross section under pressure.

Referring now to the drawings, FIG. 1 shows a vertical section of a container 10 of the related art. Container 10 has a plurality of islands 20 located in vacuum panels 30. FIG. 2 shows two horizontal sections of container 10. Section 12 shows container 10 in a normal, or non-stressed, state. Section 14 shows container 10 in a stressed state such as, for example, when container 10 is filled with hot liquid. It can be seen from FIG. 2 that substantial bulging, or barreling, takes place when container 10 is pressurized. The term "expanded circumferential length" will be used to describe the circumference of a horizontal section of container 10 when expanded to its limit (a circle) as if subjected to pressure sufficient to "straighten out" all features of the cross section. "Nominal circumference" will be used to describe the circumference of the smallest circle that completely surrounds a particular cross section when the container is in the normal, non-stressed state. The barreling seen in FIG. 2 can be reduced by reducing the difference between the expanded circumferential length and the nominal circumference of at least one of the horizontal cross sections of a container. Reducing the difference between the expanded circumferential length and the nominal circumference of a particular cross section decreases barreling because doing so decreases the amount of expansion that is available before reaching maximum expansion.

Figure 3:
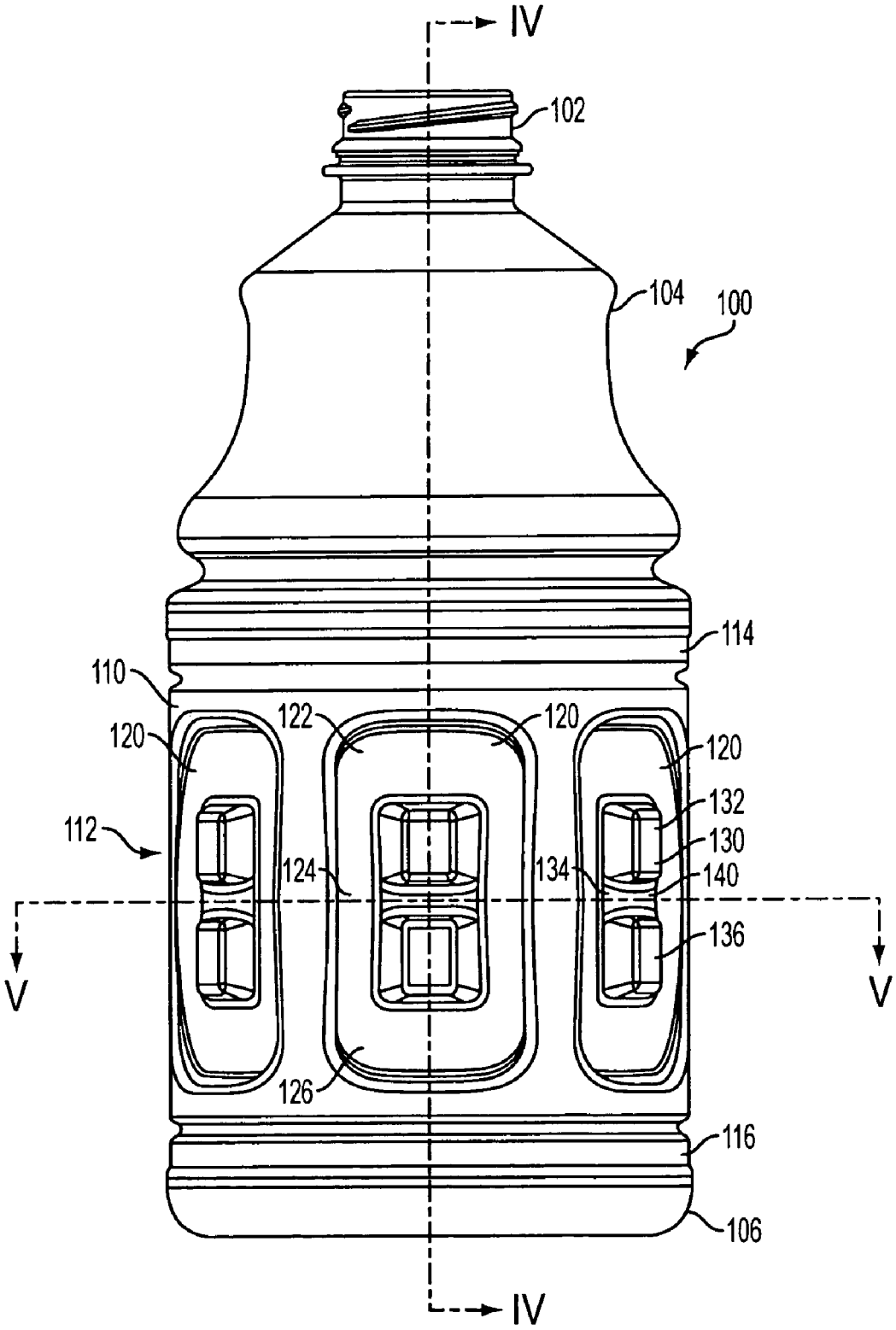
FIG. 3 shows a side view of a container in accordance with a first embodiment of the invention.
Figure 4:
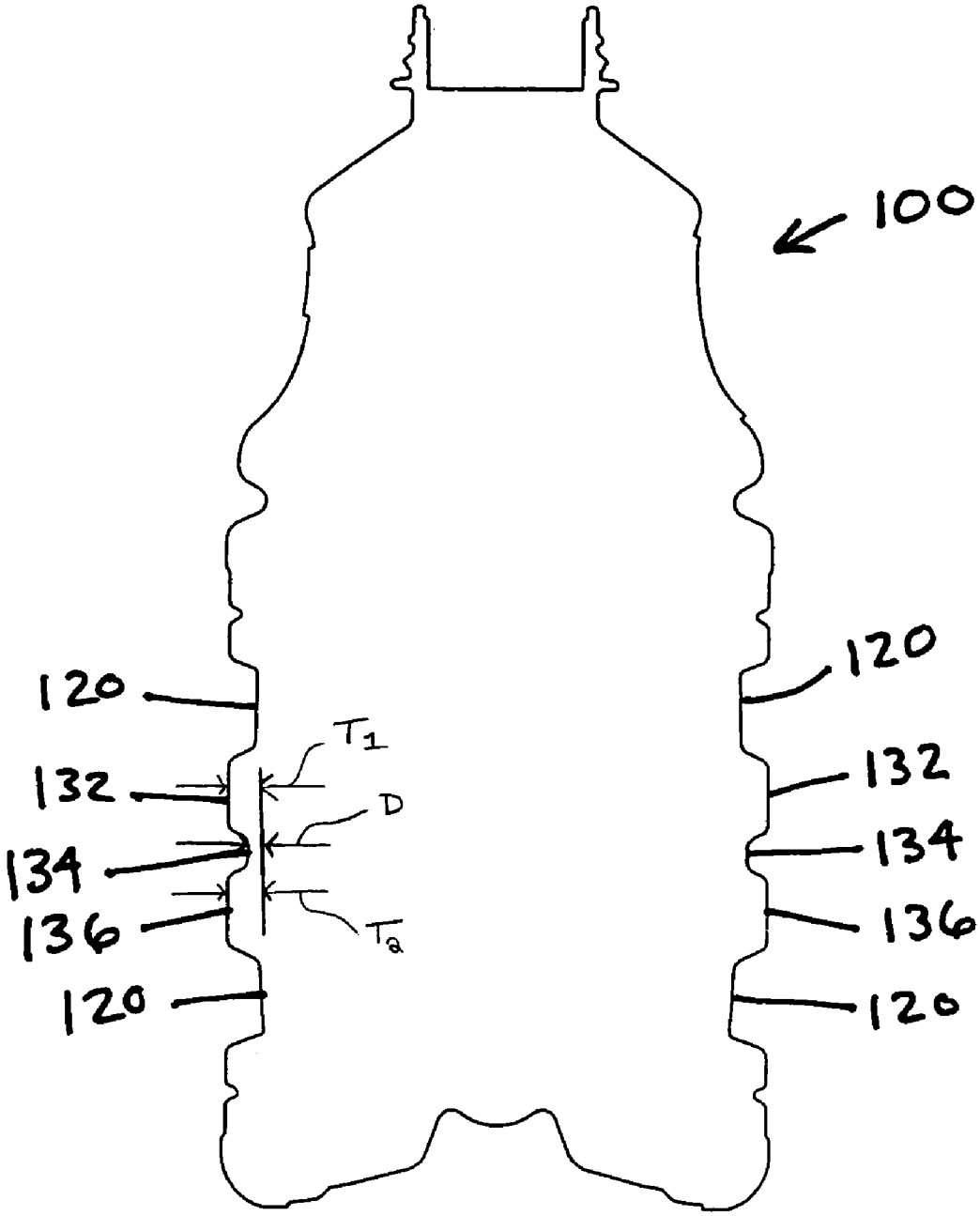
FIG. 4 shows a vertical section of the container shown in FIG. 3.
Figure 5:
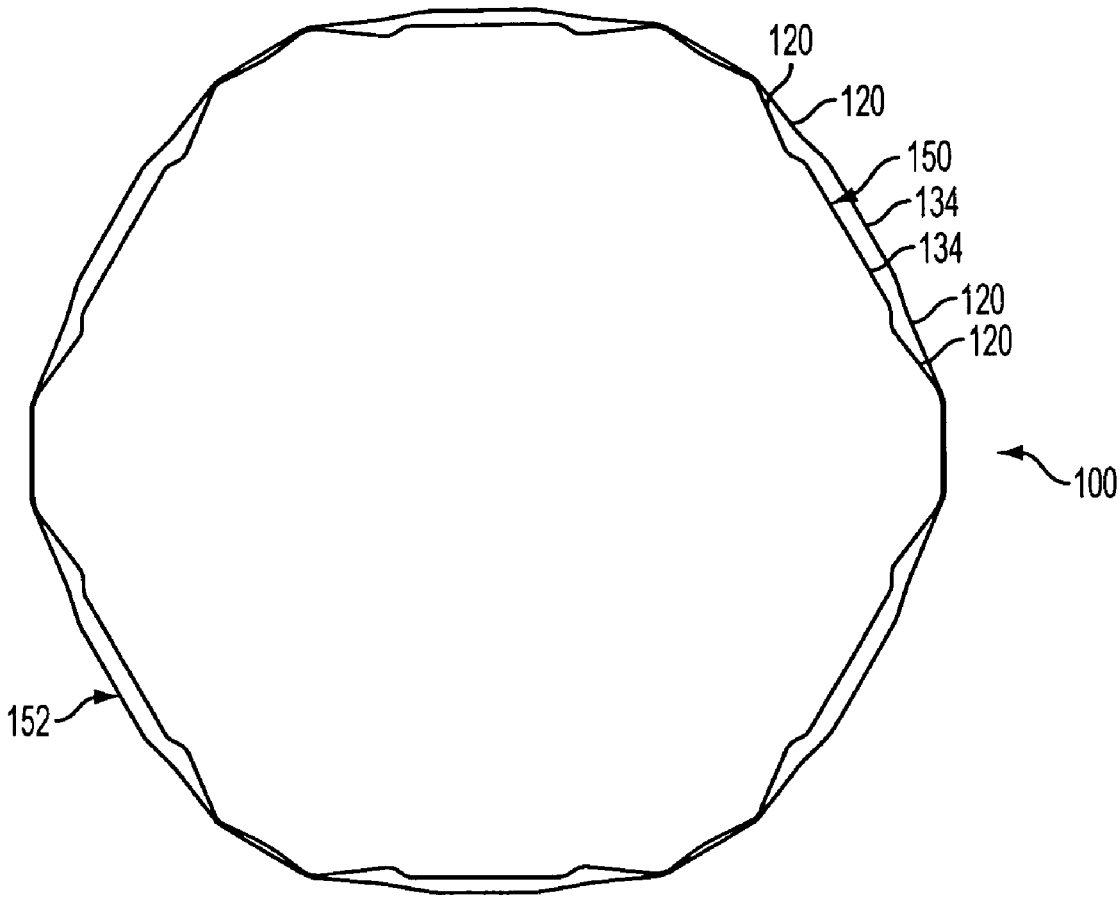
FIG. 5 shows two horizontal, mid-panel sections of the container shown in FIGS. 3 and 4, one section shows the container's nominal cross section and the other shows the container's cross section under pressure.

FIGS. 3-5 show a first embodiment of the invention. In this embodiment, a container 100 has a finish 102 for filling and dispensing fluid, a bell 104, a base 106 and a body 110. Body 110 has a generally cylindrical shape and connects base 106 to bell 104. In this example, body 110 has at least one label mounting area 112 that is located between (and includes) an upper label bumper 114 and a lower label bumper 116. A label or labels can be applied to label mounting area 112 using methods that are well known to those skilled in the art, including shrink wrap labeling and adhesive methods. The label can extend around a portion of or the entire label mounting area 112.

Disposed within the label mounting area is a series of vacuum panels 120 which, in this example, are symmetrically distributed around body 110. Vacuum panels 120 flex under the pressure of hot filling and subsequent cooling to adjust for pressure changes within container 100. A raised island 130 is located within at least one vacuum panel 120. In this example, each vacuum panel 120 surrounds a raised island 130. Islands 130 help support the label and are, in this example, centrally located within vacuum panels 120. Each island 130 has a middle portion 134 that has a reduced cross sectional area as compared to an upper portion 132 and a lower portion 136. The cross sectional areas are taken along horizontal planes of container 100.

Figure 9:
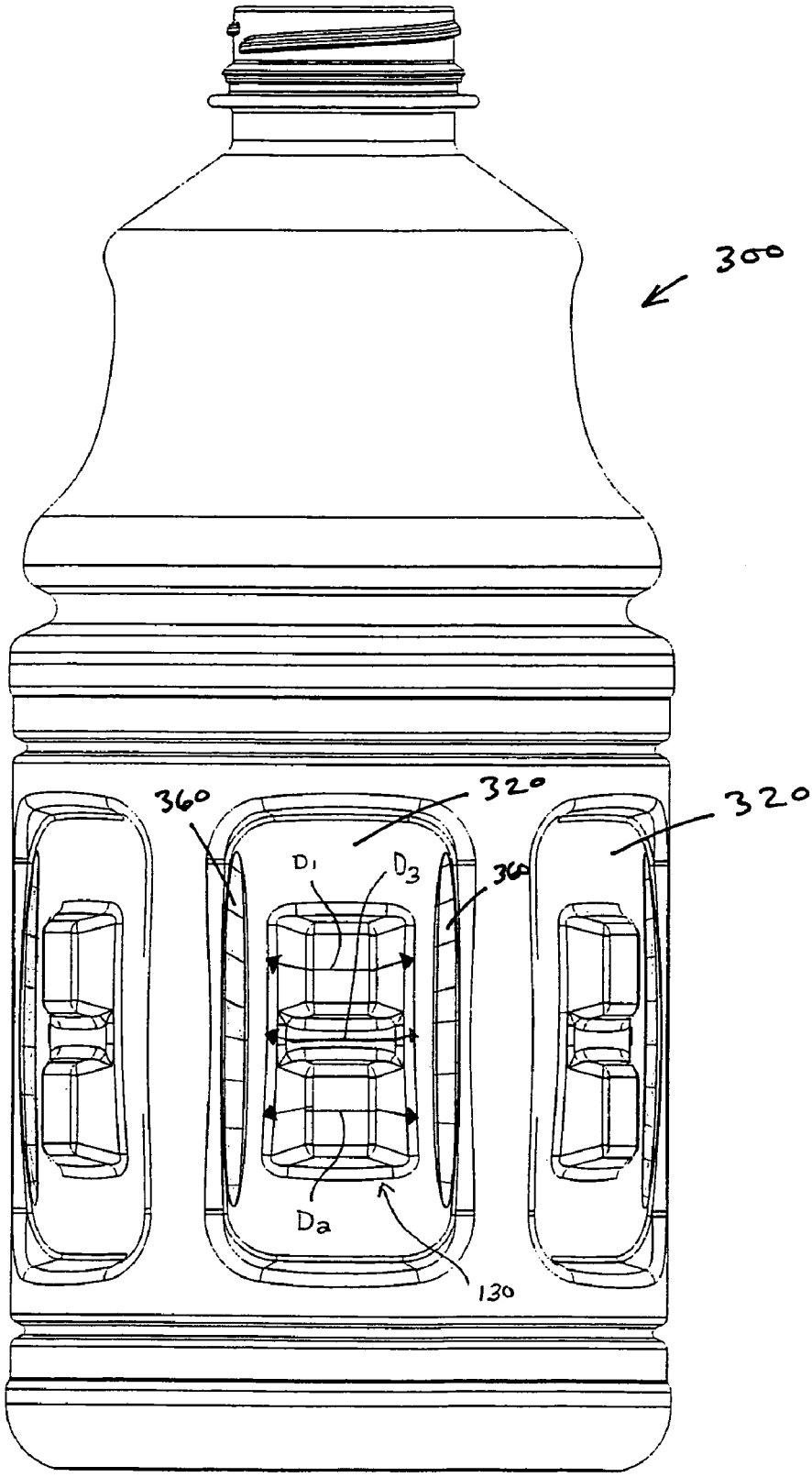
FIG. 9 shows a side view of a container incorporating the features of a third embodiment of the invention.

Middle portion 134 in the example shown in FIGS. 3-5 takes the form of a horizontal rib 140. Horizontal rib 140 is parallel to base 106 in this example, but could alternatively be non-parallel to base 106. The size of vacuum panels 120, islands 130 and horizontal ribs 140 may vary depending on container size, plastic composition, bottle filling conditions and expected contents. As illustrated in FIG. 9, a first distance D1 can extend horizontally along the exterior surface of the upper portion of the island 130 between the left and right borders of the island 130. A second distance D2 can extend similarly along the exterior surface of the lower portion of the island 130, and a third distance D3 can extend similarly along the exterior surface of the middle portion of the island 130. As shown, the third distance D3 can be less than the first distance D1 and/or the second distance D2.

FIG. 5 shows a section along section line V-V in FIG. 3. FIG. 5 shows the difference between container 100 in a normal, non-pressurized state (cross section 150) and a pressurized state (cross section 152). Comparing FIG. 5 to FIG. 2, one can readily see that much less deformation takes place in container 100 than in container 10. It is also apparent that the difference between the expanded circumferential length and the nominal circumference of container 100 is less than that of container 10. It is this smaller difference that results in reduced deformation.

The exact shape of vacuum panels 120 is not critical to the invention. Vacuum panels 120 can be of any appropriate type and can have various cross sectional shapes. For example, vacuum panels 120 can be entirely uniform or have regions having various cross sectional shapes including flat, concave and convex. The regions can be defined in terms of an upper area 122, a middle area 124 and a lower area 126. The cross sectional shape of these individual areas can be selected and varied including flat, concave and convex.

Figure 6:
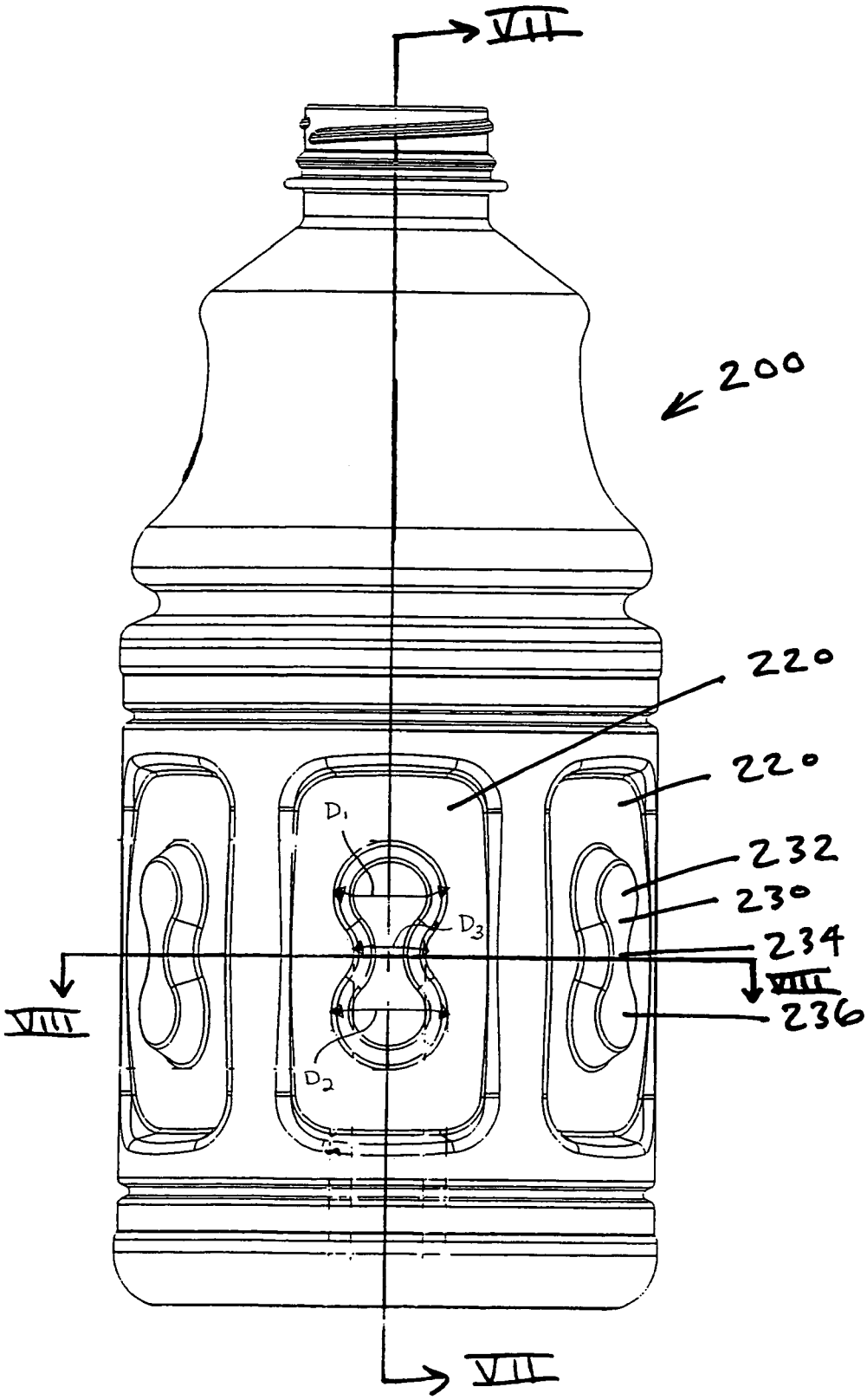
FIG. 6 shows a side view of a container in accordance with a second embodiment of the invention.
Figure 7:
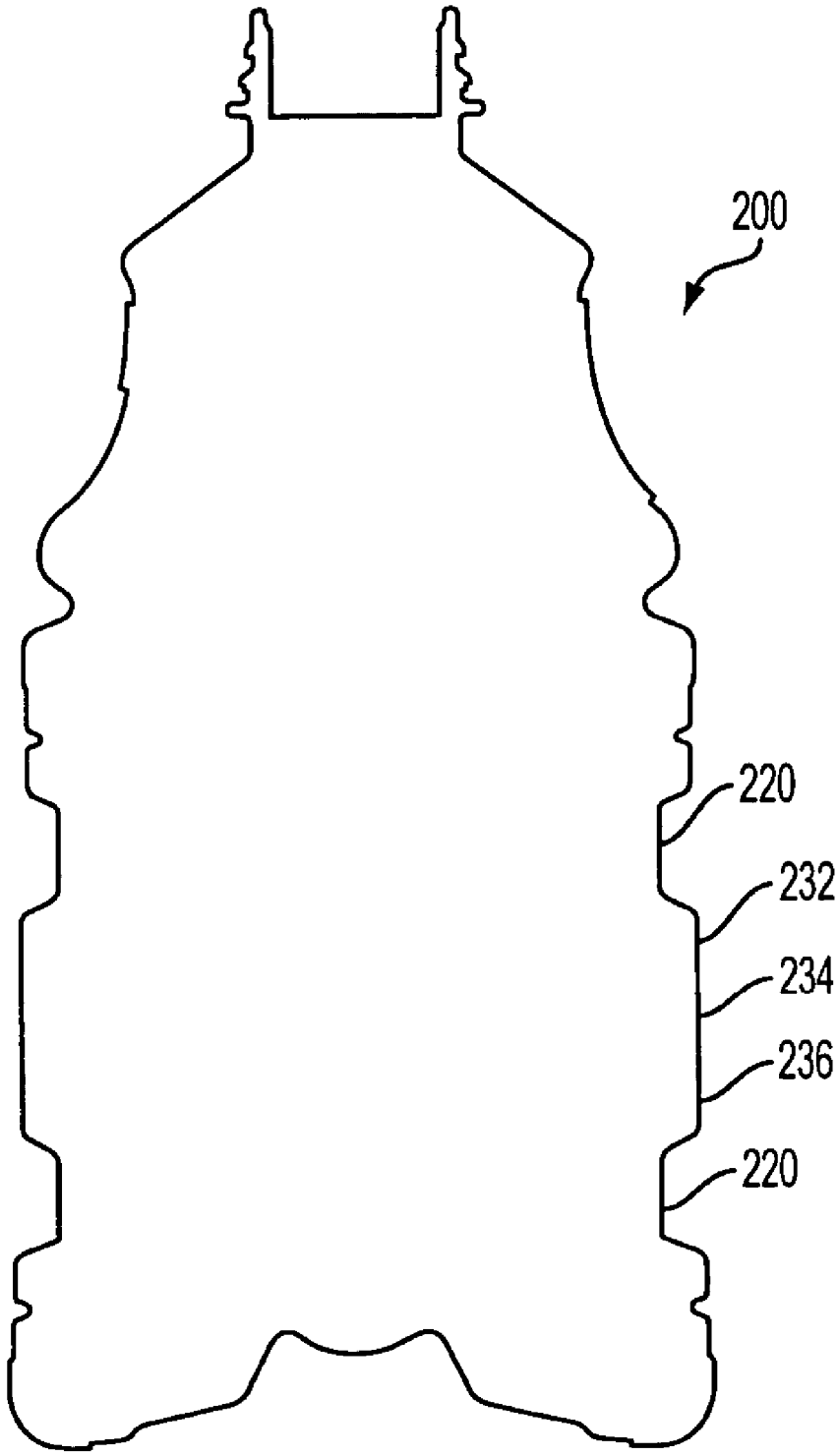
FIG. 7 shows a vertical section of the container shown in FIG. 6.
Figure 8:
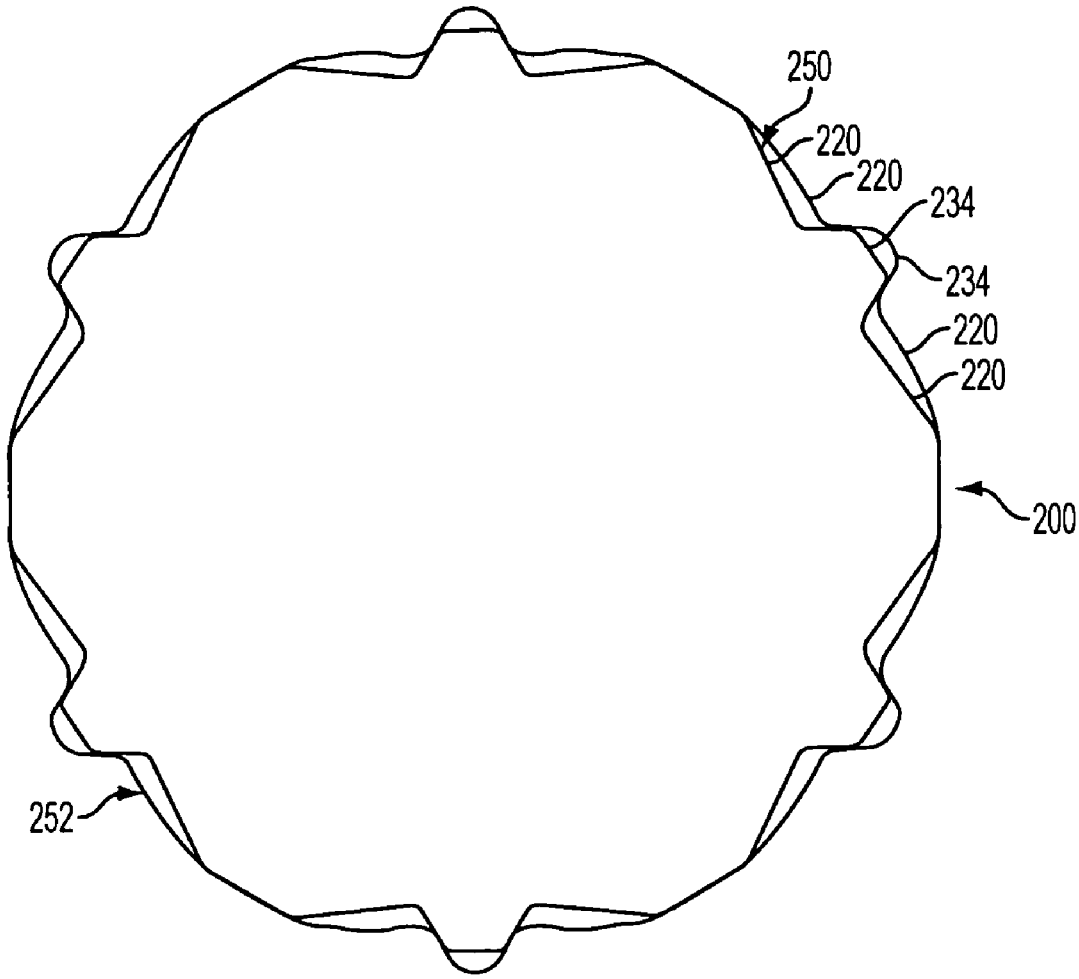
FIG. 8 shows two horizontal, mid-panel sections of the container shown in FIGS. 6 and 7, one section shows the container's nominal cross section and the other shows the container's cross section under pressure.

FIGS. 6-8 show a container 200 in accordance with a second embodiment of the invention in which islands 230 are shaped like a peanut or figure "8". Each island 230 has a middle portion 234 that has a reduced cross sectional area as compared to an upper portion 232 and a lower portion 236. The cross sectional areas are taken along horizontal planes of container 200. Unlike the example shown in FIGS. 3-5 (where the cross sectional area of middle portion 234 is reduced by reducing its dimension in the radial direction), this embodiment reduces the cross sectional area of middle portion 234 by reducing it dimension in the circumferential direction. In other embodiments, the dimension of middle portion 234 is also reduced in the radial direction. As shown in FIG. 6, a first distance D1 can extend horizontally along the exterior surface of the upper portion 232 of the island 230 between the left and right borders of the island 230. A second distance D2 can extend similarly along the exterior surface of the lower portion 236 of the island 230, and a third distance D3 can extend similarly along the exterior surface of the middle portion 234 of the island 230. As shown, the third distance D3 can be less than the first distance D1 and/or the second distance D2.

FIG. 8 shows a section along section line VIII-VIII in FIG. 6 and shows the difference between container 200 in a normal, non-pressurized state (cross section 250) and a pressurized state (cross section 252). Comparing FIG. 8 to FIG. 2, one can readily see that much less deformation takes place in container 200 than in container 10. It is also apparent that the difference between the expanded circumferential length and the nominal circumference of container 200 is less than that of container 10. It is this smaller difference that results in reduced deformation.

FIG. 9 shows a container 300 in accordance with another embodiment of the invention that includes, in this example two, vertical ribs 360 located in vacuum panels 320. In this example, vertical ribs 360 are inwardly convex, but could alternatively be inwardly concave. This configuration adds more flexibility to vacuum panels 320 which can be advantageous in high pressure situations such as, for example, nitrogen flushing.

An example of particularly useful dimensions for the vacuum panels and islands are as follows: For the panel having an island with a horizontal rib, the panel has a height of approximately 3.477 inches and a width of approximately 1.887 inches. The rectangular island is centrally placed within the panel and has a vertical length of approximately 1.959 inches and a width of approximately 1.029 inches. The horizontal rib has a depth of approximately 0.175 inch as measured from the outermost surface of the island. The island has a thickness of approximately 0.239 inch as measured from its outermost surface to the inner surface of the panel. Referring to FIG. 4, in some embodiments, the horizontal rib has a depth D of at least one-half of the thicknesses $T_1$, $T^2$ of the island. In other embodiments, the horizontal rib has a depth D of at least two-thirds of the thicknesses $T_1$, $T_2$ of the island. In still other embodiments, the horizontal rib has a depth D of at least three-quarters of the thicknesses $T_1$, $T_2$ of the island.

An example of particularly useful dimensions for the vacuum panel and peanut shaped island are as follows: The vacuum panel has the overall dimensions set forth above. The peanut shaped island is centrally placed within the panel and has the following dimensions: At its widest point, it has a width of approximately 0.975 inch and at its most narrow point, it has a width of approximately 0.604 inch. The island has a thickness of approximately 0.239 inch as measured from its outermost surface to the inner surface of the vacuum panel.

The above dimensions are offered by way of example only. The dimensions are a function of the size of the container and may be increased or decreased depending on the size and performance requirements of the container.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention.

All references cited in this specification are hereby incorporated by reference. The discussion of the references herein is intended merely to summarize the assertions made by their authors and no admission is made that any reference constitutes prior art relevant to patentability. Applicants reserve the right to challenge the accuracy and pertinence of the cited references.

The embodiments illustrated and discussed in this specification are intended only to teach those skilled in the art the best way known to the inventors to make and use the invention. Nothing in this specification should be considered as limiting the scope of the invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

What is claimed is:

1. A plastic container defining a central axis, the container comprising:

a substantially cylindrical sidewall;

a base attached to a lower portion of the sidewall;

a finish attached to an upper portion of the sidewall;

a vacuum panel located in the sidewall, the vacuum panel comprising an upper panel portion, a lower panel portion, and a middle panel portion, wherein the upper panel portion and the lower panel portion are located radially closer to the central axis than is the middle panel portion;

a raised island protruding from the vacuum panel and surrounded by the vacuum panel, cross sectional areas of the island being defined as areas in horizontal planes of the container, the island comprising:

an upper island portion;

a middle island portion adjacent to the upper island portion; and a lower island portion adjacent to the middle island portion;

wherein a cross sectional area of the middle island portion is less than a cross sectional area of the upper island portion and less than a cross sectional area of the lower island portion.

2. The container of claim 1, wherein the island is a peanut shape.

3. The container of claim 1, wherein the middle island portion is a substantially horizontal rib that has a depth in a radial direction of the container that is less than a depth, in the radial direction, of one of the upper island portion and the lower island portion.

4. The container of claim 3, wherein the depth of the middle island portion is less than one half of the depth of one of the upper island portion and the lower island portion.

5. The container of claim 4, wherein the depth of the middle island portion is less than one third of the depth of one of the upper island portion and the lower island portion.

6. The container of claim 5, wherein the depth of the middle island portion is less than one quarter of the depth of one of the upper island portion and the lower island portion.

7. The container of claim 1, wherein the raised island is bisected by the middle island portion.

8. The container of claim 1, further comprising a plurality of vacuum panels spaced symmetrically around the sidewall.

9. The container of claim 8, wherein each of the vacuum panels has a raised island protruding there from and surrounded thereby, cross sectional areas of the island being defined as areas in horizontal planes of the container, each island having an upper island portion;

a middle island portion adjacent to the upper island portion; and a lower island portion adjacent to the middle island portion;

wherein a cross sectional area of the middle island portion is less than a cross sectional area of the upper island portion and less than a cross sectional area of the lower island portion.

10. The container of claim 1, wherein the vacuum panel has two vertical ribs.

11. The container of claim 10, wherein the vertical ribs are indentations in the vacuum panel.

12. The container of claim 11, wherein the island is located between the vertical ribs.

13. A plastic container defining a central axis, the container comprising:

a substantially cylindrical sidewall having an exterior surface;

a base attached to a lower portion of the sidewall;

a finish attached to an upper portion of the sidewall;

a vacuum panel located in the sidewall, the vacuum panel comprising an upper panel portion, a lower panel portion, and a middle panel portion, wherein the upper panel portion and the lower panel portion are located radially closer to the central axis than is the middle panel portion; and a raised island protruding from the vacuum panel and surrounded by the vacuum panel, the island defined by left and right borders that delimit the island from the vacuum panel, the island including an upper island portion, a middle island portion adjacent to the upper island portion, and a lower island portion adjacent to the middle island portion;

wherein a first distance extends horizontally along the exterior surface of the upper island portion between the left border and the right border, a second distance extends horizontally along the exterior surface of the lower island portion between the left border and the right border, and a third distance extends horizontally along the exterior surface of the middle island portion between the left border and the right border, with the third distance being less than the first distance and less than the second distance.

14. The container of claim 13, wherein the raised island is a peanut shape.

15. The container of claim 13, wherein the middle island portion is a substantially horizontal rib.

16. The container of claim 13, wherein the raised island is bisected by the middle island portion.

17. The container of claim 13, further comprising a plurality of vacuum panels spaced symmetrically around the sidewall, wherein each of the vacuum panels has a raised island protruding there from.

18. The container of claim 13, wherein the vacuum panel has two vertical ribs.

19. The container of claim 18, wherein the vertical ribs are indentations in the vacuum panel.

20. A method of reducing deformation in a plastic container, the method comprising:

providing the container with a substantially cylindrical sidewall defining a central axis;

providing the container with a base attached to a lower portion of the sidewall;

providing a finish attached to an upper portion of the sidewall;

providing a vacuum panel located in the sidewall, the vacuum panel comprising an upper panel portion, a lower panel portion, and a middle panel portion, wherein the upper panel portion and the lower panel portion are located radially closer to the central axis than is the middle panel portion;

providing a raised island protruding from the vacuum panel and surrounded by the vacuum panel, cross sectional areas of the island being defined as areas in horizontal planes of the container;

providing an upper island portion;

providing a middle island portion adjacent to the upper island portion; and providing a lower island portion adjacent to the middle island portion;

wherein a cross sectional area of the middle island portion is less than a cross sectional area of the upper island portion and less than a cross sectional area of the lower island portion.

21. The method of claim 20, wherein the island provided in a peanut shape.

22. The method of claim 20, wherein the middle island portion is provided as a substantially horizontal rib that has a depth in a radial direction of the container that is less than a depth, in the radial direction, of one of the upper island portion and the lower island portion.

23. The method of claim 22, wherein the depth of the middle island portion is less than one half of the depth of one of the upper island portion and the lower island portion.

24. The method of claim 20, wherein the raised island is bisected by the middle island portion.

25. The method of claim 20, further comprising providing a plurality of vacuum panels spaced symmetrically around the sidewall, wherein each of the vacuum panels is provided with a raised island protruding there from and surrounded thereby, cross sectional areas of the island being defined as areas in horizontal planes of the container, each island having an upper island portion;

a middle island portion adjacent to the upper island portion; and a lower island portion adjacent to the middle island portion;

wherein a cross sectional area of the middle island portion is less than a cross sectional area of the upper island portion and less than a cross sectional area of the lower island portion.

26. The method of claim 20, wherein the vacuum panel is provided with two vertical ribs, the vertical ribs being indentations in the vacuum panel, and the island is located between the vertical ribs.

* * * * *